United States Patent [19]

Bitterberg

[11] 4,167,143

[45] Sep. 11, 1979

[54] PNEUMATIC BOGIE PITCH STABILIZER

[75] Inventor: Friedhelm Bitterberg, Fuldatal, Fed. Rep. of Germany

[73] Assignee: Thyssen Industrie Aktiengesellschaft, Essen, Fed. Rep. of Germany

[21] Appl. No.: 845,408

[22] Filed: Oct. 25, 1977

[30] Foreign Application Priority Data

Oct. 23, 1976 [DE] Fed. Rep. of Germany ..... 2648113

[51] Int. Cl.[2] ..... B61F 1/10; B61F 3/04; B61F 5/24; B61F 5/52

[52] U.S. Cl. ..... 105/164; 105/175 A; 105/184; 105/199 R; 105/210; 267/3

[58] Field of Search ..... 105/164, 197 B, 199 R, 105/182 R, 175 A, 184, 210; 267/65 D, 3

[56] References Cited

U.S. PATENT DOCUMENTS

| | | | |
|---|---|---|---|
| 2,969,975 | 1/1961 | Chuba | 267/65 D |
| 3,896,740 | 7/1975 | Kreissig | 105/199 R X |

FOREIGN PATENT DOCUMENTS

| | | | |
|---|---|---|---|
| 2135633 | 2/1973 | Fed. Rep. of Germany | 105/164 |

*Primary Examiner*—Albert J. Makay

*Assistant Examiner*—Howard Beltran

*Attorney, Agent, or Firm*—Becker & Becker, Inc.

[57] ABSTRACT

A rail vehicle having a driving bogie frame and a vehicle frame, in which these frames are interconnected by means of supporting springs and at least one of the end faces of said frames are interconnected by air springs. The air springs communicate with a source of compressed air through a conduit system having two branch lines respectively connected to the interior of the air springs while adjustable pressure control valves are respectively arranged in these branch lines. The two branch lines are interconnected by a conduit having an adjustable throttle valve interposed therein. Depending on the respective driving direction of the vehicle by adjusting the valves in the branch lines a differential pressure is established between the air pressures in the air springs connected to the branch lines so that the respective end of the bogie frame is pulled up or pressed down so that the wheel set relief is compensated for. Thus the control of the air pressure in the air springs during operation of the rail vehicle is carried out automatically in conformity with the pulling force acting upon the pulling force of the driving body of the vehicle.

3 Claims, 3 Drawing Figures

PNEUMATIC BOGIE PITCH STABILIZER

The present invention relates to a device for preventing driving bogies from tilting on beaming up or disengaging the rails when such bogies are subjected to an excessive pulling force, and also for exerting a dampening of the pitching of rail vehicles.

More specifically, the present invention relates to an arrangement as set forth in the preceding paragraph according to which the bogie frame and the vehicle frame are by supporting springs and at least at one of its end faces interconnected by compressed air controlled elements which through the intervention of a conduit system communicate with a source of pressure while valves are provided for the adjustment of the pressure force.

For the transmission of maximum pulling forces at difficult starting and for a stable quiet and oscillation-free movement of the vehicle at high speeds, means are provided between the bogie frame and the vehicle frame resiliently resting thereon, which means prevent the interfering movements created by the starting and acceleration forces. In view of the beaming up moment which is proportional to the pulling force and to the height of the bogie linkage above the upper edge of the rail, a loading or relieving of load of the wheel sets occurs which acts upon the transmittable pulling force between wheel and rail.

A conveying of the optimum pulling force between wheel and rail is, however, possible only by an axle equalization, which means with the same wheel set loads in a bogie in conformity with the respectively prevailing axle loads. Therefore, with driving bogies for locomotives or self-propelled rail vehicles, an optimum pulling force transmission between wheel and rail prevails only when none of their driving axles is so relieved that it can race.

Prior art discloses a hydraulic stabilizing device for dampening the pitching movements of rail vehicles, which stabilizing device comprises double-acting hydraulic telescopic cylinders arranged between the two front and the two rear supporting springs of the vehicle on the vehicle upper structure. Of these telescopic cylinders, the working chambers of one longitudinal side of the vehicle are interconnected by a compensating line or conduit, and the compensating lines on both sides are connected to a likewise double-acting control cylinder. This known device has the drawback that it acts only upon the movements of the vehicle box relative to the bogies and that in view of the continuous movement of the pistons in the cylinders a considerable wear occurs at the joints of the angle levers and also high servicing and maintenance costs are involved aside from the fact that repair requires the idling of the respective vehicle.

With rail vehicles equipped with driving bogies it is known to arrange a tackle between the vehicle box and the frame for the bogie in order to avoid any major swaying tendency In this connection, however, it is left open how the tackle is connected with the vehicle box and the bogie frame so that the oscillations will be absorbed and the swaying movement will be prevented. With the heretofore known designs, the tackle is by means of angle levers and compressed air cylinders preloaded if desired.

It is an object of the present invention so to improve the above outlined device that it will for all practical purposes work wear-free, will have a structure as simple as possible, and can easily be serviced while the other movements are only slightly affected by the bogie and the vehicle box.

These and other objects and advantages of the invention will appear more clearly from the following specification in connection with the accompanying drawings, in which.

The device according to the invention is characterized primarily in that as elastic elements are used air springs known per se while the control of the air pressure in said air springs is automatically effected in conformity with the pulling force.

According to a further development of the invention, each air spring is connected to the bogie frame and through the intervention of a traverse is frictionally by means of two steel cables connected directly or indirectly to the vehicle frame. Furthermore, the air springs are respectively arranged in pairs in such a way that said air springs are respectively diametrically connected to the bogie frame and directed in opposite direction while the steel cables of the upper air spring extend downwardly to a support or a connecting rod of the vehicle frame whereas the steel cables of the lower air spring extend upwardly to the transverse beam of the vehicle frame.

A preferred embodiment of the invention provides that a throttle valve for dampening the pitching movement of the vehicle is installed in the conduit system for the air springs of a bogie frame.

Figure 1:
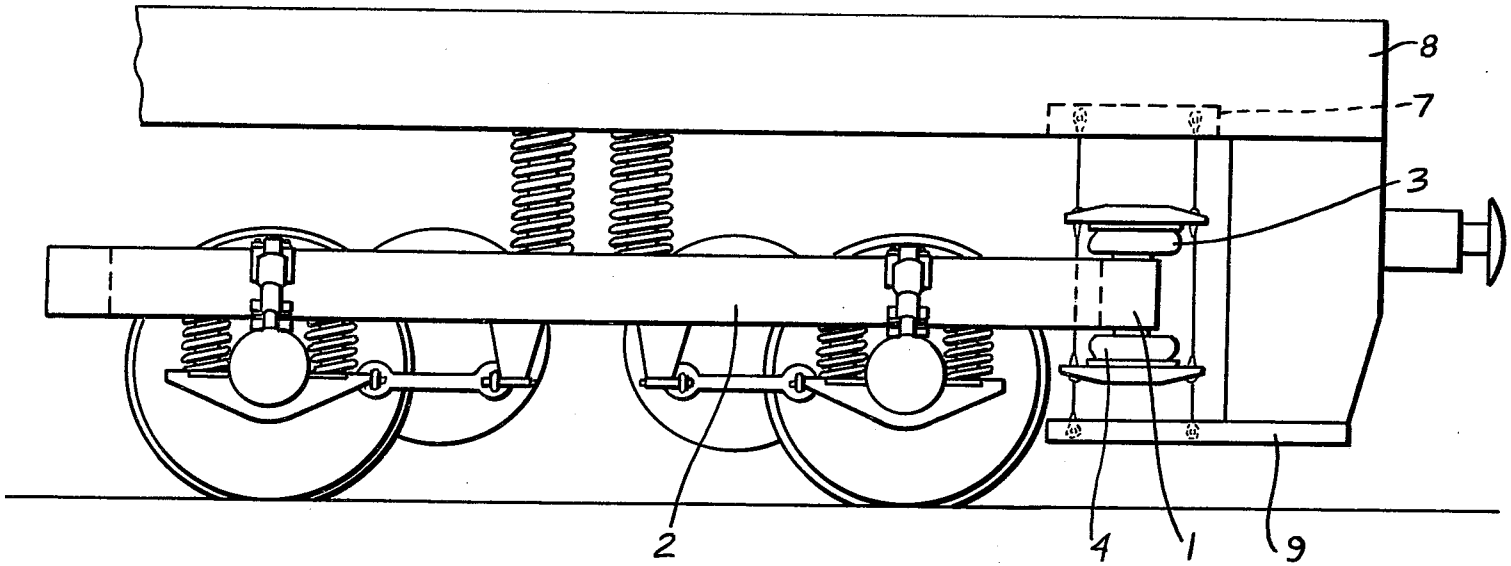
FIG. 1 is a side view of a bogie according to the invention.
Figure 2:
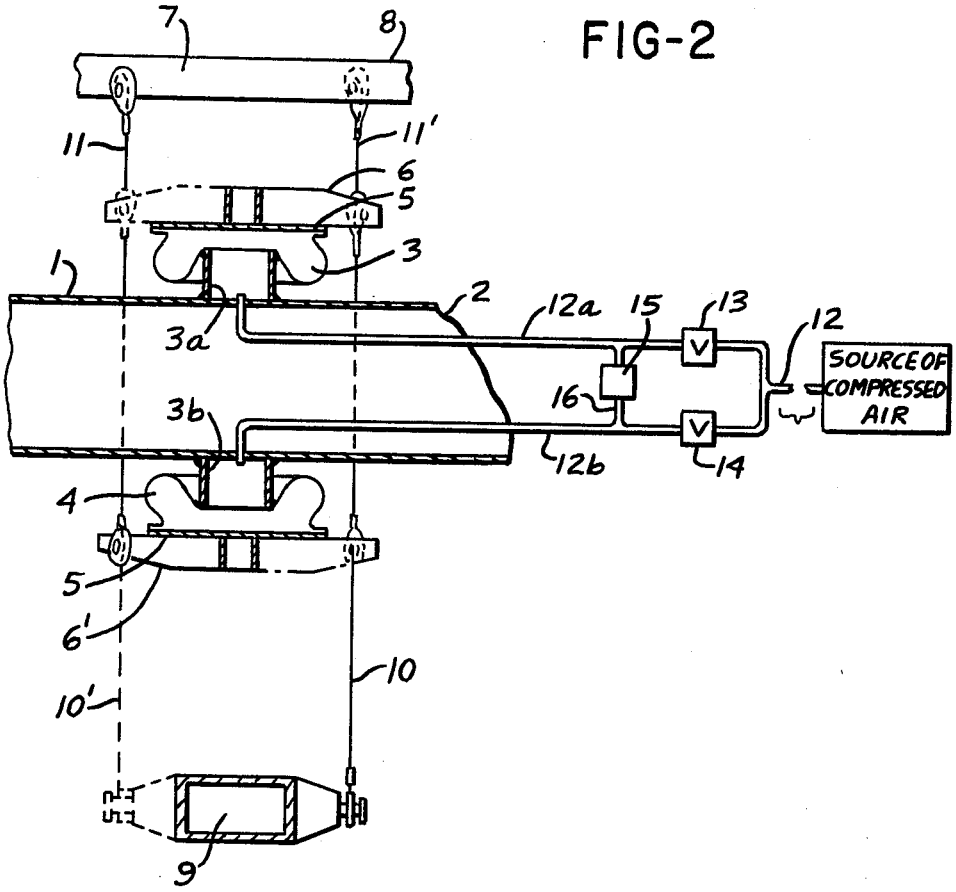
FIG. 2 represents a section taken along the line II—II of FIG. 3.
Figure 3:
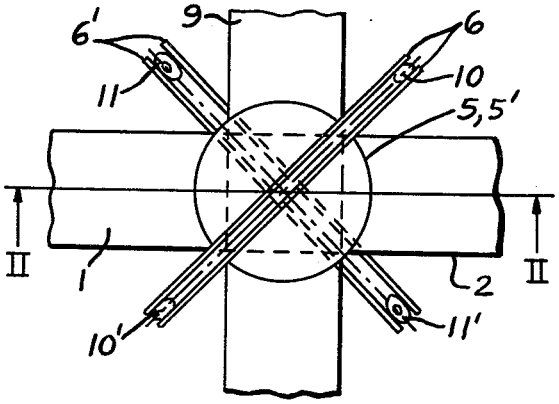
FIG. 3 is a top view of FIG. 2 while only those elements are shown which are essential for the invention.

Referring now to the drawings in detail, the embodiment shown therein comprises an end transverse beam 1 of a bogie frame 2 which in its intermediate region has its top and bottom sides respectively provided with air springs 3 and 4. Each of these air springs is fixedly connected with the end transverse beam 1 through the intervention of cylindrical holding means 3*a*, and is connected to a conduit system of a source of compressed air. In this connection, each air spring 3,4 is on that side which faces away from the bogie frame, by means of its foot portion and a clamping ring connected to a cover 5,5' in a gas-tight manner. The said cover 5,5' has that side thereof which is located opposite the air spring, provided with a traverse or beam means 6,6'. The traverse 6 of the upper air spring 3 is offset by 90° relative to the traverse 6' of the lower air spring 4 as shown in FIG. 2. For clearer illustration, FIG. 2 shows both traverses 6 and 6' in the same plane in the drawing in dot-dash lines. The two traverses have their ends provided with connecting pins for receiving the steel cables. Connecting pins for the steel cables are also provided on the transverse beam 7 of the vehicle frame 8 as well as on a support or a connecting rod 9 of the vehicle frame 8. These connecting pins are arranged below the horizontal plane of the bogie frame 2. Steel cables 10, 10' connected to the traverse 6 of the upper air spring 3 extend downwardly to the support or connecting rod 9 of the vehicle frame 8 and are there likewise connected. Steel cables 11, 11' extending from the traverse 6' of the lower air spring 4 extend upwardly to the transverse beam 7 of the vehicle frame 8 and are connected to the connecting pins.

In the conduit system, a conduit 12 originating with the source of compressed air, is divided into two conduit strands 12*a*, 12*b* which lead to the two air springs 3,4. Control valves 13, 14 are respectively arranged in said conduit branches 12*a*, 12*b*. The two conduit branches are through a tap line 16 connected to each other, which tap line comprises a throttle valve 15. The air supply to the air springs 3,4 is effected through said conduit branches 12*a*, 12*b* and the control valves 13 and 14 respectively interposed therein. Depending on the direction of driving, by adjusting a differential pressure between the two air spring pressures, the end of the bogie frame is pulled up or pressed down so that the relief of the wheel set is compensated for. If the pulling forces which have to be transmitted from the driving sets to the rail are so small that no wheel set relief has to be compensated for, both air springs 3,4 will obtain a uniform overpressure. The air springs are short circuited by means of the throttle valve 15. The open throttle valve 15, however, throttles the air passing therethrough to such an extent that a dampening of the pitching movements of the bogie will occur.

The advantages realized by the present invention consist primarily in that over the heretofore known designs with compressed air cylinders and linkage system there is provided a wear-resistant structure with which the air springs operate practically in a wear-free manner and in which the steel cables which are always under a preload are not subject to wear.

It is, of course, to be understood that the present invention is, by no means, limited to the specific showing in the drawings, but also comprises any modifications within the scope of the appended claims.

What I claim is:

1. In an apparatus for preventing pitching of a driving bogie with a frame and a vehicle body frame under pulling force effectiveness and for damping vertical movements of a rail vehicle with supporting springs interconnecting the bogie frame and the vehicle body frame, such apparatus being arranged at least at one interface of the bogie frame and supported respectively at least at one of the locations including an upper and also an underside of the bogie frame on one hand and the vehicle frame on the other hand while providing air springs located one above another and pressure controlled by a conduit system connected to a source of compressed air and alternately operable valve means provided for adjustment of pressure force, the improvement in combination therewith comprising: supports on the bogie frame for the air springs located one above the other, each of the supports including beam means connected to the air springs, the air springs being arranged in pairs with one air spring of each pair being connected to the top side of the bogie frame and the other air spring of the same pair being connected to the bottom side of said bogie frame, and steel cables fastened to the respective airspring and to said vehicle frame, said beam means of both air springs being angularly offset relative to each other by substantially a right angle.

2. In an apparatus according to claim 1, in which the steel cables connected to the air spring on the top side extend downwardly, and steel cables connected to the lower air spring extend upwardly to the vehicle body frame.

3. In an apparatus according to claim 1, in which adjustable pressure control valve means are built into the conduit system of both air springs of the bogie frame.

* * * * *